US005092483A

United States Patent [19]

McKelvy

[11] Patent Number: 5,092,483

[45] Date of Patent: Mar. 3, 1992

[54] COMPONENT RETAINING PRESSURE RELIEF SYSTEM

[75] Inventor: Marvin D. McKelvy, Centralia, Mo.

[73] Assignee: A.B Chance Co., Centralia, Mo.

[21] Appl. No.: 650,292

[22] Filed: Feb. 4, 1991

[51] Int. Cl.[5] ..... B65D 51/16; B65D 45/00

[52] U.S. Cl. ..... 220/327; 220/89.2; 220/203; 220/328; 220/366

[58] Field of Search ..... 220/327, 203, 252, 316, 220/328, 366, 89.2, 89.1, 208

[56] References Cited

U.S. PATENT DOCUMENTS

| | | | |
|---|---|---|---|
| 1,311,957 | 7/1919 | Ferris . | |
| 1,343,480 | 6/1920 | Rutherford . | |
| 1,549,665 | 8/1925 | Hill et al. | 220/89.2 |
| 1,729,085 | 9/1929 | Pofeldt | 220/89.2 |
| 2,017,600 | 10/1935 | Lofton . | |
| 2,158,293 | 5/1939 | Lingal | 220/203 X |
| 2,330,130 | 9/1943 | Marburg | 220/328 |
| 2,590,803 | 3/1952 | Unger et al. | 220/328 |
| 2,603,739 | 7/1952 | Steen | 220/366 X |
| 3,008,483 | 11/1961 | Beckwith . | |
| 3,057,603 | 10/1962 | Isreeli | 220/327 X |
| 3,313,599 | 4/1967 | Boon | 220/327 X |
| 3,331,397 | 7/1967 | Mueller et al. . | |
| 3,439,831 | 4/1969 | Pullen | 220/366 X |
| 3,439,947 | 4/1969 | Luckenbill et al. . | |
| 3,497,395 | 2/1970 | Kohen . | |
| 3,502,361 | 3/1970 | Sieverin . | |
| 3,845,876 | 11/1974 | Needham et al. | 220/203 |
| 4,458,711 | 7/1984 | Flider | 220/203 X |
| 4,495,147 | 1/1985 | Fricker et al. . | |
| 4,717,178 | 1/1988 | Daghe et al. . | |
| 4,821,909 | 4/1989 | Hibler et al. . | |
| 4,909,276 | 3/1990 | Bayly et al. . | |

*Primary Examiner*—Stephen Marcus
*Assistant Examiner*—Vanessa Caretto
*Attorney, Agent, or Firm*—Hovey Williams Timmons & Collins

[57] ABSTRACT

A pressure vessel includes an enclosure adapted to contain a structural assembly in a pressurized environment. The vessel includes first and second enclosure components which together define the enclosure, the first enclosure component is movable relative to the second enclosure component which permits the enclosed pressure to be vented. Structure is provided for coupling between the first and second enclosure components, wherein the structure becomes inoperative when the pressure within the vessel reaches a predetermined excessive level thereby allowing the first enclosure component to separate from the second enclosure component. Structure for limiting the distance the first enclosure component may separate from the second enclosure component is also provided.

8 Claims, 1 Drawing Sheet

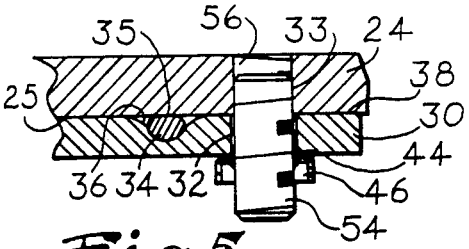
Fig. 5.
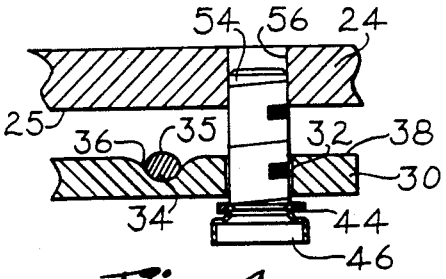
Fig. 4.
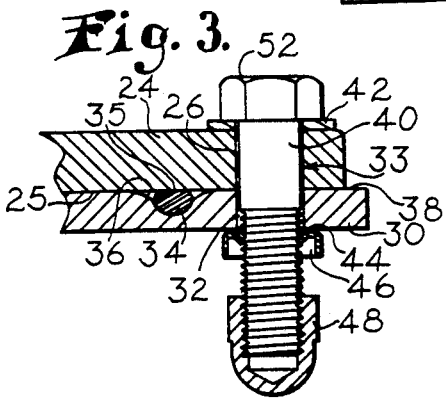
Fig. 3.
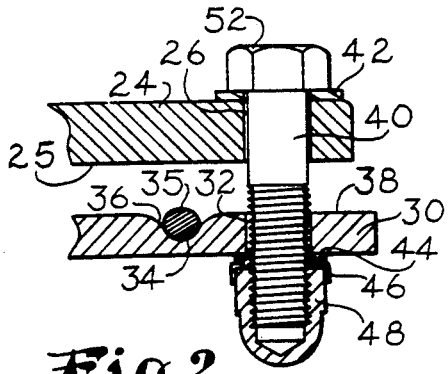
Fig. 2.
Fig. 1.
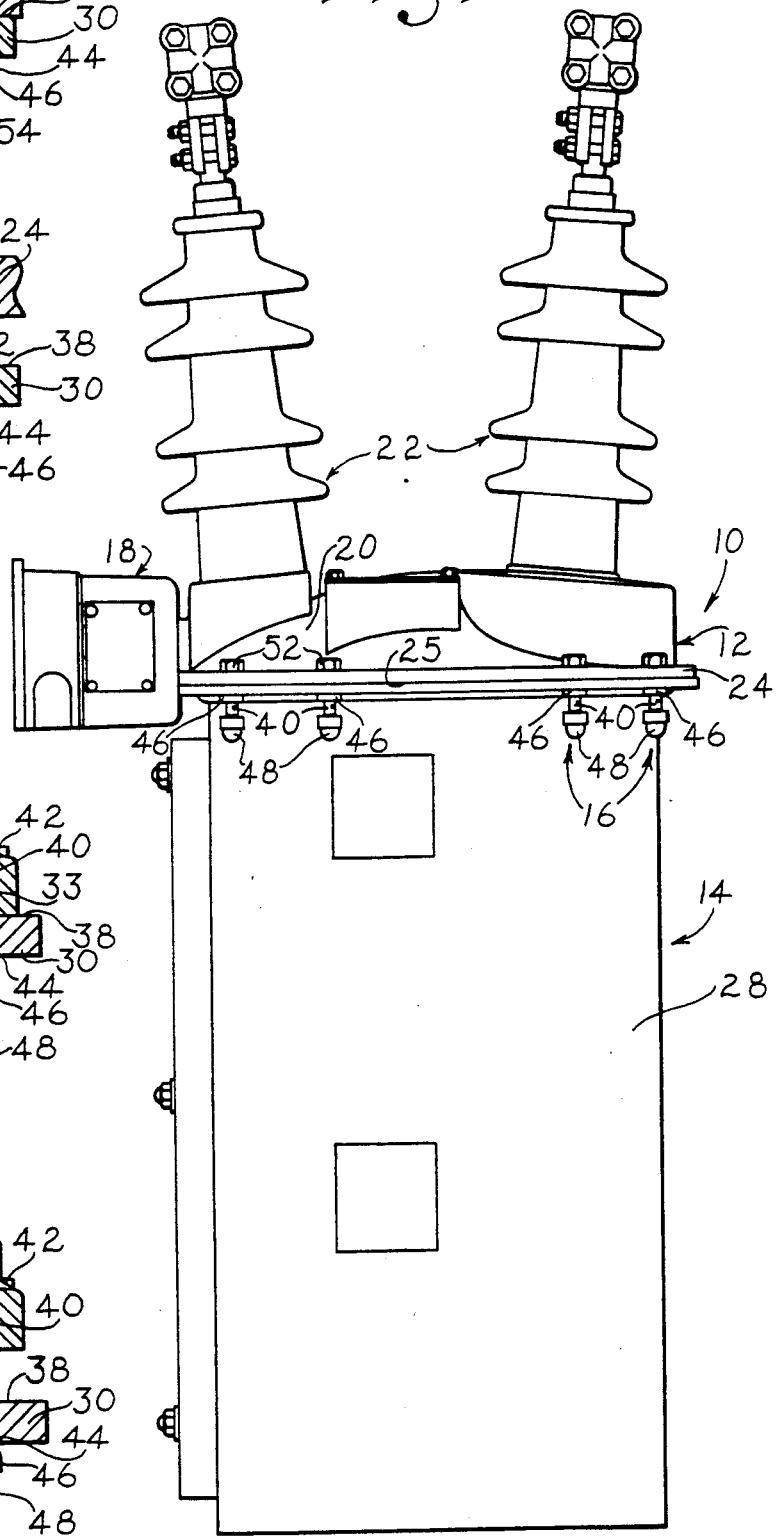

COMPONENT RETAINING PRESSURE RELIEF SYSTEM

BACKGROUND OF THE INVENTION

1. Field of the Invention

This invention relates to a vessel which normally contains a structural assembly under pressure higher than ambient, and has structure to allow the higher pressure to be vented to the atmosphere. More particularly, it is concerned with venting the pressure very quickly by allowing a component of the vessel to be moved away from the remaining portion of the vessel while limiting the distance the component will move.

2. Description of the Prior Art

A pressure vessel which normally maintains a low pressure (less than 20 p.s.i.) under extreme conditions may be subjected to a rapid and large increase in pressure. For example, an electrical recloser which is contained in a pressure vessel may have uncontrolled electrical arcing which in turn causes a pressure increase of up to 1000 p.s.i./sec.

It is desirable to vent this pressure while also retaining all the vessel parts. The rapid increase of pressure precludes the use of devices such as "pop-off" valves because such valves cannot vent a sufficient amount of gas quickly enough to prevent a catastrophic explosion.

A number of pressure relief devices have been proposed in the past for a variety of uses. In general, these units have been designed to relieve a relatively slow pressure build up and also maintain a sealed vessel after the excess pressure has been vented. However, these units have not met the needs for relieving a very large and fast build up of pressure.

One approach which has been proposed is connecting the component to the vessel using a nut and bolt with a sleeve placed between the nut and the vessel. The sleeve, which surrounds the stud bolt, will collapse and allow the component to separate and vent the pressure. A problem experienced with this approach is that the sleeve does not allow precise changes to be made in the pressure level to be vented and is expensive to install.

OBJECTS AND SUMMARY OF THE INVENTION

It is an object of the present invention to provide a pressurized vessel, including first and second components sealed together by a plurality of nut and bolt assemblies, having means for venting a large volume of excessive pressure very quickly by stripping the nuts to separate the first component from the second component.

It is a further object of the invention to provide an increased measure of safety by preventing a catastrophic explosion of the vessel.

The component retaining relief system in accordance with the present invention meets these and other objectives and also, in large measure, solves the problems outlined above. A pressure vessel comprising an enclosure is adapted to contain a structural assembly in a pressurized environment. The vessel includes first and second enclosure components which together define the enclosure, the first enclosure component being movable relative to the second component to permit the enclosed pressure to be vented. Attachment means are provided for coupling engagement between the first and second enclosure components, wherein the attachment means becomes inoperative when the pressure within the vessel reaches a predetermined level thereby allowing the first enclosure component to separate from the second enclosure component. Also provided are means for limiting the distance the first component may separate from the second component.

BRIEF DESCRIPTION OF THE DRAWINGS

FIG. 1 is a side elevational view of an electrical recloser including a component retaining pressure relief system in accordance with the preferred embodiment of the invention.

FIG. 2 is a vertical sectional view of the preferred system after pressure has been vented.

FIG. 3 is a vertical sectional view of the preferred system in a sealed state.

FIG. 4 is a vertical sectional view of the system within the lever box after pressure has been vented.

FIG. 5 is a vertical sectional view of the system within the lever box in a sealed state.

DETAILED DESCRIPTION OF THE PREFERRED EMBODIMENT

Referring now to the drawing, a component retaining pressure relief system 10 in accordance with the invention broadly includes a top lid 12, a housing 14, bolt assemblies 16 and a lever box 18. The top lid 12 is attached to the housing 14 with the bolt assemblies 16 which creates a seal between the lid 12 and the housing 14 thus permitting the interior of the housing 14 to be held at pressures greater than ambient. The lever box 18 is an external connection to allow manual opening and closing of an electrical recloser.

In more detail, the component retaining pressure relief system 10 in the disclosed embodiment of the invention is an electrical recloser assembly. The top lid 12 includes a generally convex shaped cover 20 with sheds 22 attached thereto so that there is an electrical connection which extends through the cover 20. An annular rim 24, presenting a generally planar bottom surface 25, is affixed to the lowermost portion of the lid 12, as shown in FIG. 1, and includes a plurality of spaced apart apertures 26, which are shown in FIG. 2.

Referring back to FIG. 1, the housing 14 includes a generally cylindrical body 28 with a substantially planar bottom (not shown). An annular rim 30, similar to annular the rim 24, is attached to the body 28 at the top edge thereof so that a right angle is formed at the connection between the rim 30 and the body 28.

As can best be seen in FIG. 3, the annular rim 30 also contains a plurality of apertures 32 which correspond to the apertures 26 such that when the top lid 12 is placed on the housing 14 each the apertures 26 align with the apertures 32, effectively creating openings 33 through both the rims 24 and 30. A pliable, circular gasket 34, presenting an apex 35, lies in a chase 36 on the rim 30 between the apertures 32 and the connection with the body 28. The rim 30 presents a generally planar top face 38 which is at a level below that of the apex 35, as best seen in FIG. 2.

The bolt assemblies 16 include bolts 40, washers 42, 44 and nuts 46, 48. The bolts 40 include heads 52.

During assembly of the system 10 the top lid 12 is placed on the housing 14 so that the bottom surface 25 rests on the top face 38. Referring now to FIG. 3, to attach the top lid 12 to the housing 14, the apertures 26 and 32 are aligned and the bolts 40 are passed through the washers 42 and the openings 33 which are slightly larger in diameter than the bolts 40. The openings 33 are larger than the bolts 40 so that the bolts 40 will not inhibit the separation of the top lid 12 from the housing 14.

The washers 44 are now slipped onto the bolts 40 and the nuts 46 are threaded onto the bolts 40 until the bottom surface 25 is tightened against the top face 38 with the gasket 34 being compressed to create an air-tight seal. Next, the nuts 48, preferably acorn nuts, are threaded onto the ends of the bolts 40.

The lever box 18 is connected to both the rim 24 and the rim 30 and because of space limitations within the lever box 18 a bolt assembly other than that described above is required. FIG. 4 schematically illustrates the bolt assembly within the lever box 18. A bolt 54 is threaded into an aperture 56 on the rim 24 and passed through an aligned aperture 32. A washer 44 is slipped onto the bolt 54 and a nut 46 is then threaded onto the bolt 54 until it couples the rims 24 and 30 together.

In the disclosed embodiment of the present invention an electrical recloser is contained within the system 10 in a pressurized atmosphere. Typically, the pressure within the system 10 is only a few pounds per square inch (less than 20 p.s.i.). However, under certain conditions, such as uncontrolled electrical arcing, there can be a rapid pressure build up (1000 p.s.i./sec.) which needs to be quickly relieved.

To accomplish this the nuts 46 are preferably formed of sheet metal and only have one thread, which is strong enough to sufficiently seal the top lid 12 and the housing 14 together, under normal conditions. However, when excessive pressure builds up within the system 10 the nuts 46 will strip on the bolts 40 and allow the top lid 12 to move relative to the housing 14 thus allowing the excessive pressure to be vented into the atmosphere. Preferably the nuts 46 are Palnuts, regular lock nut type, commercially available from TRW, Inc. in the PAL85 catalog, part no. RR 3816.

The pressure at which the nuts 46 will strip can be varied by controlling the material with which the nuts 46 are made as well as by altering the thread pitch diameter and the number of threads. For example, the softer the material of nuts 46 is the lower the pressure is at which the nuts 46 will strip on bolts 40.

Another method of accomplishing the desired stripping would be to make the pitch diameters of the nuts 46 large enough relative to the bolts 40 that the nuts would strip at the desired pressure level but would otherwise maintain a tight seal.

The nuts 48, which are stronger than the nuts 46, prevent the top lid 12 from being totally disconnected from the housing 14. Obviously, the bolts 40 must be long enough to allow sufficient ventilation of the internal pressure and along with the nuts 48 strong enough to prevent the top lid 12 from being blown completely off of the housing 14.

As those skilled in the art will appreciate, it is noted that substitutions may be made for the preferred embodiment and equivalents employed herein without departing from the scope of the present invention as recited in the claims. For example, the bolt material and thread pitch diameter could be varied to allow the bolt threads to strip instead of the nut threads. Also, cotter pins or the like could be used instead of the nuts 48 to retain the top lid 12 on the housing 14.

What is claimed is:

1. A pressure vessel comprising:

an enclosure adapted to contain a structural assembly in a pressurized environment, the vessel including a top lid and a housing which together define the enclosure, the top lid including a plurality of spaced apart apertures around the periphery thereof and being movable relative to the housing to permit the enclosed pressure to be vented, the housing including a plurality of spaced apart apertures around the periphery thereof in alignment with the apertures of the top lid, each pair of aligned apertures receiving an elongated member;

attachment means operably coupled to at least one of the elongated members for providing coupling engagement between the top lid and housing, wherein the attachment means becomes inoperative when the pressure within the vessel reaches a predetermined excessive level thereby allowing the top lid to separate from the housing; and means for limiting the distance the top lid may separate from the housing, wherein the elongated members are threaded bolts, the attachment means being nuts which engage the threads of the bolts and which will strip at the predetermined excessive pressure level.

2. The vessel as set forth in claim 1, wherein the nut is composed of metal forming at least one thread.

3. The vessel as set forth in claim 1, wherein the nut threads are composed of a soft material relative the bolt material.

4. The vessel as set forth in claim 1, wherein the nut has a large pitch diameter relative to that of the bolts.

5. The vessel as set forth in claim 1, wherein at least some of the bolts are longer than the length required to couple the top lid to the housing, the limiting means including a nut attached to the threaded end of each of the longer bolts.

6. A pressure relief assembly for relieving a predetermined pressure level within an enclosed vessel, comprising:

a vessel including structure defining an opening with a plurality of spaced apart apertures around the periphery of the opening;

covering means for covering the opening including structure defining a plurality of spaced apart apertures around the periphery of the covering means, the apertures of the covering means aligning with the apertures of the vessel when the covering means is placed over the opening;

a plurality of threaded bolts which fit within the aligned apertures of the vessel and covering means;

attachment means operably coupled to the threaded bolts for attaching the covering means to the vessel, the attachment means including means for becoming uncoupled from the threaded bolts when the pressure level within the vessel reaches a predetermined excessive level, the attachment means including nuts which engage the threads of the bolts and which will strip at the predetermined excessive pressure level; and means for limiting the distance that the covering means may separate from the vessel.

7. A vessel having a pressurized region within which a structural assembly is adapted to be supported, the vessel comprising:

first and second components which together define the region of the vessel to be pressurized, the first component being movable relative to the second component to expose the region to ambient pressure;

locking means for providing pressure sealing engagement between the first and second components, the locking means including at least one threaded elongated member supported on one of the first and second components for movement therewith, and a threaded nut engageable with the threaded elongated member, the other of the first and second components including an engagement portion positionable between the nut and the one of the first and second components so that the first and second components are put in pressure sealing engagement when the nut is tightened on the elongated member; and the threads of one of the nut and the elongated member including stripping means for stripping the threads when the pressure within the region exceeds a predetermined pressure in order to permit relative movement between the first and second components so that the region is vented.

8. The vessel as set forth in claim 7 further comprising:

means for limiting the distance that the first component may separate from the second component.

* * * * *